United States Patent [19]

Joubert

[11] Patent Number: 4,524,001

[45] Date of Patent: Jun. 18, 1985

[54] METHOD OF PURIFYING URANIFEROUS AQUEOUS SOLUTIONS

[75] Inventor: Philippe Joubert, Lyons, France

[73] Assignee: Uranium Pechiney, Paris, France

[21] Appl. No.: 534,341

[22] Filed: Sep. 21, 1983

[30] Foreign Application Priority Data

Oct. 4, 1982 [FR] France ..... 82 17102

[51] Int. Cl.[3] ..... C02F 1/52

[52] U.S. Cl. ..... 210/713; 210/724; 210/737; 423/11; 423/85; 423/608

[58] Field of Search ..... 210/713, 724, 737, 723, 210/912; 423/85, 11, 608, 18, 20

[56] References Cited

U.S. PATENT DOCUMENTS

| | | | |
|---|---|---|---|
| 3,093,452 | 6/1963 | Newby | 423/11 |
| 3,790,658 | 2/1974 | Fox et al. | 423/18 |
| 3,988,414 | 10/1976 | Klicka et al. | 423/18 |
| 4,256,463 | 3/1981 | Carter | 423/85 |
| 4,272,490 | 6/1981 | Sefton et al. | 423/20 |
| 4,330,509 | 5/1982 | Henry | 423/608 |

*Primary Examiner*—Benoit Castel

*Attorney, Agent, or Firm*—McDougall, Hersh & Scott

[57] ABSTRACT

A method of purifying uraniferous aqueous solutions containing impurities, particularly at least one of the elements zirconium and/or hafnium, and also containing at least one of the anions $SO_4^{=}$, $NO_3^{-}$, $Cl^{-}$ or $F^{-}$ acting as complexing agents for the uranium and impurities, by precipitation of said impurities by means of an alkaline agent, characterized in that the following stages are carried out for the purpose of selectively and quantitatively separating the impurities from the uranium:

(a) said uraniferous solution is brought to a temperature of at least 40° C., (b) the content of complexing agent is adjusted to bring the molar ratio: [complexing agent]/[soluble U+Zr and/or Hf] to at least 3, (c) the pH of said solution is adjusted between 2.2 and 4.3 by introducing an alkaline agent.

7 Claims, 1 Drawing Figure

METHOD OF PURIFYING URANIFEROUS AQUEOUS SOLUTIONS

BACKGROUND OF THE INVENTION

The invention concerns a method of purifying uraniferous acid aqueous solutions which contain impurities, the impurities particularly including at least one of the elements zirconium and/or hafnium and at least one of the anions $SO_4^=$, $NO_3^-$, $Cl^-$ or $F^-$. The purification is achieved through precipitation of said impurities by means of an alkaline agent.

Known prior art methods involved with uraniferous ores containing impurities such as zirconium and/or hafnium lead to the production of impure uraniferous concentrates containing from 0.5 to 6% of zirconium relative to the uranium. Although up to a recent date such a quantity of impurities was tolerated by the industries concerned with treating and purifying these concentrates, these industries are at present far more demanding, firstly because of the great difficulties experienced during the purifying treatments, and secondly because of the purity requirements on the part of users. As a matter of fact a standard has been published since 1981, defining the purity of uraniferous concentrates and putting the threshold of impurities for zirconium at less than 0.01% by weight relative to the uranium (ASTM standard No. C967-81).

Such a low impurity threshold for zirconium cannot be obtained by the methods known and described in the literature since, as already mentioned, such methods result in an unacceptable content of impurities.

A uranium upgrading treatment may be applied to uraniferous aqueous solutions resulting, for example, from action on a uranium containing ore, leading to the production of a uranate such as described in "The extractive Metallurgy of Uranium" by R. Merrit, Edition 1971—Colorado School of Mines Research Institute. The product obtained is an impure uraniferous concentrate, since the processing comprises a single stage of precipitation of the uranium by means of an alkaline agent. This gives the uraniferous medium treated a pH of at least 6 and preferably above that level, while bringing about simultaneous precipitation of the uranium and impurities such as zirconium and/or hafnium.

A uranium upgrading treatment may also be applied to these same uraniferous aqueous solutions, leading to precipitation of uranium peroxide, as described in R. Merrit, edition 1971, pages 247 and 248, and in "Proceeding of the International Conference on the peaceful uses of Atomic Energy" United Nations, Vol. VIII, pp. 141 to 143 (1955) by E. L. Zimmer on "Preparation and Separation of Uranium Peroxide, as a stage in the chemical purification of Crude Uraniferous Products". These articles mention that, although precipitation of uranium in the impure solution containing it theoretically enables the impurities present to be kept in solution, the uraniferous precipitate obtained retains not inconsiderable quantities of impurities at the time when the said precipitate is separated. This happens despite consistent and extended washing; thus, precipitation and washing of the uranium peroxide provide a satisfactory way of removing impurities such as silver, arsenic, aluminum, boron, bismuth, calcium, magnesium, manganese, molybdenum, vanadium, sodium, nickel, antimony, tin and zinc, but do not result in adequate elimination of iron, phosphorus and silicon, unless other purifying treatments are carried out at a preliminary stage.

When the uraniferous solution also contains other impurities such as zirconium and/or hafnium, these are generally precipitated simultaneously with the uranium, during the hydrogen peroxide treatment of the aqueous solutions containing them. The resultant product is a uranium peroxide which does not subsequently provide a pure enough uranium for nuclear applications.

The specialized literature also proposes zirconium-uranium separating methods starting from aqueous solutions containing these two elements. Such methods could be used for purification treatment of uraniferous liquors containing zirconium and/or hafnium among other impurities.

One of these processes is described in Czech Pat. No. 187,528 and comprises crystallizing a tetrahydrated zirconium sulfate with a concentrated solution of sulfuric acid, within the range from 30% to 50% by weight. However, such a process has disadvantages which mean that it is of little use industrially: on the one hand it keeps a relatively large quantity of zirconium in solution (of the order of 10% by weight of the initial zirconium) and this is subsequently precipitated with the uranium. Secondly, it requires an extremely large quantity of alkaline agent to neutralize the free acidity and precipitate the uranium at a pH of over 6.

Another of these processes, described in U.S. Pat. No. 4,330,509, claims precipitation of zirconium by means of tartaric acid or ammonium tartrate in a zirconiferous acid liquor where the pH is kept within the range from 0.2 to 1. If such a process were applied to an acid uraniferous solution containing zirconium and/or hafnium among other impurities, the zirconium would be precipitated, simultaneously leading to the precipitation of a large quantity of uranium, which would represent an unacceptable loss for an industrial process.

Thus, the prior art offers unsatisfactory solutions for treatment of a uraniferous liquor containing zirconium and/or hafnium among the impurities present, since the treatments proposed lead to simultaneous precipitation of uranium and at least some of the above-mentioned specific impurities. This necessitates a purification treatment to obtain the purity required in nuclear applications.

SUMMARY OF THE INVENTION

The invention comprises a method of purifying uraniferous liquors which do not have the above-mentioned disadvantages and which produces a uraniferous liquor of much improved purity.

The method of the invention particularly relates to purifying uraniferous aqueous solutions containing zirconium and/or hafnium among other impurities and also containing at least one of the anions $SO_4^=$, $NO_3^-$, $Cl^-$ or $F^-$ acting as complexing agents for the uranium and impurities, by precipitation of said impurities by means of an alkaline agent. The method is characterized in that the following stages are carried out for the purpose of selectively and quantitatively separating the impurities from the uranium:

(a) said uraniferous solution is brought to a temperature of at least 40° C.;

(b) the content of complexing agent is adjusted to bring the molar ratio: [complexing agent]/[soluble U+Zr and/or Hf] to at least 3; and, (c) the pH of said solution is adjusted between 2.2 and 4.3 by introducing an alkaline agent.

DESCRIPTION OF THE DRAWING

The drawing comprises a diagrammatic illustration of the process steps of the invention.

DETAILED DESCRIPTION OF THE INVENTION

Figure 1:
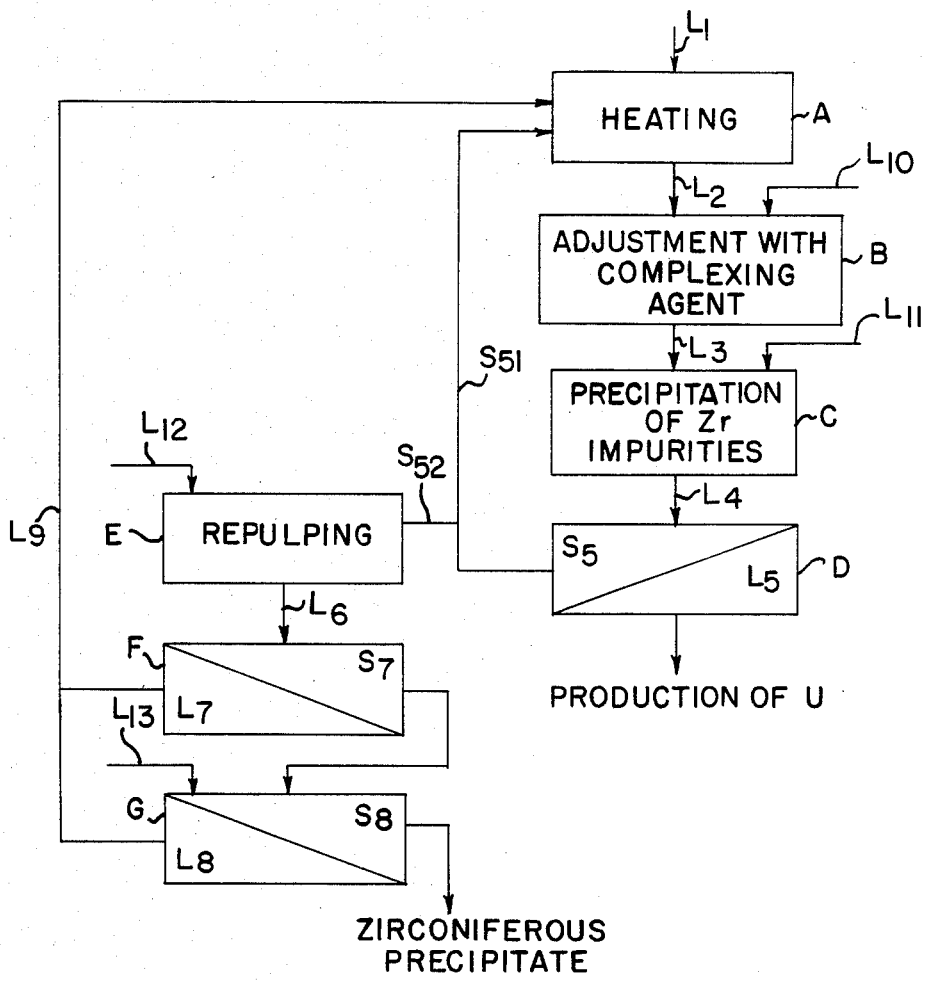

The uraniferous aqueous solutions subjected to the method of the invention are generally those obtained from hydrometallurgical treatment of uranium, well known in the art. These solutions, which may initially be acid or which may be acidified, contain a major proportion of impurities, particularly zirconium and/or hafnium.

In the first stage, the uraniferous solution to be treated is brought to a temperature of at least 40° C., for the purpose of obtaining an easily separable precipitate of impurities containing zirconium and/or hafnium, since below that temperature the precipitate always has the appearance of a gel which is very difficult to separate. The precipitate of impurities is all the more easily separated from the liquid phase if the uraniferous solution to be treated is brought preferentially to a temperature chosen within the range from 80° C. to the solution boiling temperature.

In the second stage, it has been found that the presence of at least one complexing agent for uranium and the impurities, selected from the anions $SO_4^=$, $NO_3^-$, $Cl^-$ and $F^-$, encourages selectivity of separation. Furthermore, the molar ratio of said complexing agent and of the cumulative value for the soluble uranium and zirconium and/or hafnium has to be at least 3 in order to limit, or still better prevent, simultaneous precipitation of part of the uranium with virtually all the zirconium and/or hafnium. The higher said molar ratio, the more such selectivity is encouraged, and the molar ratio is preferably chosen above 5.

The complexing agent according to the invention must be added to the solution to be treated in appropriate quantities to obtain the desired molar ratio as previously defined. However, the complexing agent may be initially present in the uraniferous solution to be treated, and in this case if the desired molar ratio is not obtained, the agent is added to bring the solution to that ratio. Finally, the complexing agent may be one of the anions $SO_4^=$, $NO_3^-$, $Cl^-$ and $F^-$ or may be a mixture of at least two of said anions.

In the third stage, the solution brought to the desired temperature and containing the appropriate quantity of complexing agent is treated by the addition of an alkaline agent to bring the pH of the solution within the range from 2.2 to 4.3.

The alkaline agent used in the method of the invention is generally selected from the group comprising alkaline hydroxides and ammonium hydroxides and also the corresponding carbonates and bicarbonates. The alkaline agent is generally introduced slowly into the hot uraniferous solution to be treated according to the invention, over a period of at least 10 minutes, so that the precipitate obtained can easily be separated from its mother liquor. It is desirable for said alkaline agent to be in the form of an aqueous solution of a molar concentration no greater than four.

Thus by carring out the stages of the method according to the invention, the solid and liquid phases, resulting from treatment by any known means, can easily be separated. A liquid phase is obtained, consisting of a purified uraniferous solution, of a purity level which easily corresponds to the above-mentioned ASTM standard, the solution subsequently being used to produce uranium by the application of known methods.

In a modified embodiment of the invention, the conditions for separating the solid and liquid phases resulting from the treatment can be improved, by recycling the solid phase separated at the end of said treatment to the beginning of the purifying treatment. After such separation the solid phase rich in zirconium forms a zirconiferous concentrate which may be upgraded by methods known in the art.

In practice, the method of purifying uraniferous aqueous solutions according to the invention, which may be applied continuously or discontinuously, comprises the following stages in an industrial context:

(a) raising the temperature of said solution to at least 40° C., (b) adjusting the content of complexing agent in the solution resulting from (a) to bring the molar ratio [complexing agent]/[soluble U+Zr and/or Hf] to at least 3, (c) adjusting the pH of the solution obtained from (b) to from 2.2 to 4.3 by introducing alkaline agent, (d) transferring the suspension emanating from stage (c), which is subjected to "clarification - separation", enabling the solid and liquid phases to be collected, the liquid phase forming the liquor producing the uranium, (e) pulping (repulpage) a fraction of the solid phase separated at stage (d) with an acid solution, while the other fraction is recycled to stage (a), (f) separating a solution charged with uranium and with a small proportion of resolubilized impurities, which is recycled to stage (a), from a solid phase essentially containing zirconium and/or hafnium, and (g) washing the solid phase resulting from stage (f) with an acid liquor, with recycling of the effluent solution to stage (a), and obtaining the zirconiferous concentrate.

The invention will be more fully understood from the following description which includes references to the drawing illustrating the stages of the process.

In the drawing, the impure uraniferous solution $L_1$, which is subjected to the process according to the invention, is introduced into zone (A), together with the recycled acid solution $L_9$ and the solid fraction $S_{51}$, which is also recycled and is rich in zirconium. The resultant suspension is brought to a temperature of at least 40° C. Then the hot solution $L_2$ is introduced into zone (B), where the molar ratio:

[complexing agent]/[soluble U+Zr and/of Hf] is adjusted by an addition through $L_{10}$. Then:

the hot suspension $L_3$, which is adjusted with complexing agent, undergoes an operation at (C) to adjust the pH within the limits from 2.2 to 4.3 by the introduction of alkaline agent $L_{11}$;

the neutralized suspension $L_4$ is subjected to a separating operation in zone (D), to give the uranium-producing solution $L_5$ and a cake $S_5$ rich in zirconium; and, the cake $S_5$ is separated into two fractions, the larger one $S_{51}$ being recycled to the beginning of the treatment in zone (A), while the other $S_{52}$ is fed to the repulping process (E). The fraction $S_{52}$ is suspended in an acid solution $L_{12}$. In an embodiment, not shown in the figure, the solid fraction $S_{52}$ is recycled directly to the action on the uraniferous ore.

The suspension $L_6$ resulting from repulping is then subjected to a liquid-solid separating operation at (F), the liquid phase ($L_7$) being recycled to (A) while the solid phase $S_7$ undergoes an operation of washing at (G) with an acid solution $L_{13}$.

The solution $L_8$, which is the effluent from washing at (G), is combined with the filtering solution $L_7$. The mixture thereof forms the solution $L_9$ which is recycled to (A).

Finally, the cake $S_8$ which is rich in zirconium and decontaminated from uranium is extracted from the circuit and provides a zirconiferous concentrate which can be upgraded.

EXAMPLE 1

The purpose of this example is to illustrate the effect of temperature on the nature of the precipitate rich in zirconium.

For this purpose 400 $cm^3$ of a uraniferous solution $L_1$ is used, of the following composition (in percentages by weight):

| | |
|---|---|
| U | 2.27 |
| Zr | 0.41 |
| $SO_4^=$ | 9.35 |
| water and incidental impurities | 87.97 |

The solution has a pH of 1.5. The molar ratio:

$$\frac{[\text{complexing agent}]}{[\text{soluble U + Zr and/or Hf}]}$$

has a value of 8.

Two tests, each involving 200 $cm^3$, are carried out at two different temperatures, test A at 20° C. and test B at 90° C., when the pH has been adjusted to a value of 4, by introducing alkaline agent in the form of a 2.86 molar aqueous ammoniacal solution in the course of one hour.

When the treatment is over, the mean particle diameter is measured with a "COULTER" counter well known in the art:

Test A gives a mean particle diameter of less than 0.3 microns, which does not allow for separation of phases by filtration.

Test B gives a mean particle diameter of 2 microns, which allows for easy separation of the phases.

EXMAPLE 2

This example illustrates the effect of the molar ratio:

[complexing agent]/[soluble U+Zr and/or Hf] on the quantity of uranium present in the zirconiferous preprecipitate.

Two tests on 1000 $cm^3$ are carried out, by varying the quantity of complexing agent, on the basis of a uraniferous solution of the following composition (in percentages by weight):

| TEST | C | D |
|---|---|---|
| U | 2.27 | 2.27 |
| Zr | 0.41 | 0.41 |
| Complexing agent $SO_4^=$ in g/l | 54 | 123 |

-continued

| TEST | C | D |
|---|---|---|
| Molar ratio | 3.5 | 8.0 |

The solution to be treated has a pH of 1.5.

The temperature at which both tests are carried out is 90° C.

The pH of the hot solutions is adjusted by slowly introducing the alkaline agent, in the course of one hour, in the form of an ammoniacal aqueous solution with a molar concentration of 0.286.

The following are obtained at the end of the treatment given in the two tests:

in the case of test (C), a zirconiferous precipitate containing 99.9% by weight of zirconium present in the solution and 25% by weight of the uranium present in the uraniferous starting solution, in the case of test (D), a zirconiferous precipitate containing 99.9% by weight of the zirconium present in the solution and 2% by weight of the uranium present in the uraniferous starting solution.

Thus, comparison of the two tests C and D shows, by varying the molar ratio, that:

the quantity of zirconium precipitated is always the same whatever the ratio;

the higher the above-mentioned molar ratio, the more the uranium remains in solution.

EXAMPLE 3

This example illustrates the solubility of zirconium in a uraniferous solution as a function of the pH level.

1.5 $cm^3$ per hour of a uraniferous solution of the following composition (in percentages by weight) is treated continuously in an industrial pilot plant:

| | |
|---|---|
| U | 3.18 |
| Zr | 0.14 |
| $SO_4^=$ | 4.88 |
| water and incidental impurities | 91.80 |

The solution is brought to a temperature of 92° C.±5° C. then kept at that level.

The molar ratio [complexing agent]/[soluble U+Zr and/or Hf] is equal to 3.45 in that solution.

The residence time of the liquor in the installation is 1 hour 30 minutes for each pH level studied.

For each pH level studied, the zirconium and uranium still in solution is analyzed, in a sample taken after the solid phase (zirconiferous precipitate) has been eliminated.

All the results are set out in table (1) below:

TABLE 1

| TESTS | pH | soluble Zr mg/l | soluble U mg/l | Zr/U ppm by weight |
|---|---|---|---|---|
| E | 2.65 | 875 | 22230 | 39000 |
| F | 2.90 | 390 | 22190 | 17500 |
| G | 3.20 | 150 | 22080 | 6900 |
| H | 3.50 | 25 | 22010 | 1100 |
| I | 3.60 | 20 | 21990 | 910 |
| J | 3.65 | 13 | 21980 | 590 |
| K | 3.70 | 7.5 | 21010 | 340 |
| L | 3.80 | 3.5 | 21000 | 166 |
| M | 3.90 | 1.5 | 20050 | 74 |
| N | 4.00 | 1.0 | 19750 | 51 |
| O | 4.10 | 0.5 | 14390 | 35 |
| P | 4.20 | 0.4 | 13060 | 31 |

TABLE 1-continued

| TESTS | pH | soluble Zr mg/l | soluble U mg/l | Zr/U ppm by weight |
|---|---|---|---|---|
| Q | 4.30 | 0.4 | 11710 | 34 |

It appears possible from the table to obtain selective separation of the zirconium and other impurities from the uranium, in spite of the fact that the molar ratio is less favorable since it is close to the lower threshold of 3.

EXAMPLE 4

Applicants give this example to illustrate the importance of recycling the zirconiferous precipitate in the method of the invention.

In the test and in a first sequence $R_1$, one liter of the same uraniferous solution as was described in Example 1, where the initial pH was 1.5, is brought to a temperature of 90° C. The hot uraniferous solution is then treated with a 2.86 molar ammoniacal solution, which is introduced in approximately 30 minutes until a pH of 4 is obtained.

When the neutralizing agent has been introduced, the suspension resulting from the treatment is kept agitated at a temperature of 90° C. for a period of 30 minutes.

At the end of this first sequence, the mean diameter of the particles in suspension is measured with a "COULTER" counter. The zirconiferous precipitate is then separated from the purified uraniferous solution.

The zirconiferous precipitate obtained in the course of this first sequence of treatment is introduced, in a second sequence $R_2$, into one liter of the same uraniferous solution to be treated. The suspension thus obtained undergoes the same procedure as the treatment in sequence $R_1$, that is to say, at the same temperature, pH and duration.

Thus, five sequences of treatment numbered from $R_1$ to $R_5$ are carried out step-by-step, at the end of which the mean diameter of the particles obtained is systematically measured by means of the above-mentioned apparatus.

All the results are summarized in Table 2 below:

TABLE 2

| No. of sequence | Mean diameter in microns |
|---|---|
| $R_1$ | 2.06 |
| $R_2$ | 5.14 |
| $R_3$ | 5.54 |
| $R_4$ | 6.29 |
| $R_5$ | 7.79 |

From the results thus summarized, it can be desirable to recycle the zirconiferous precipitate obtained in the method of the invention.

It will be understood that various changes and modifications may be made in the method of the invention without departing from the spirit of the invention particularly as defined in the following claims.

I claim:

1. In a method of purifying uraniferous aqueous solutions containing impurities comprising at least one of the elements zirconium and/or hafnium, and also containing at least one of the anions $SO_4^{=}$, $NO_3^-$, $Cl^-$ or $F^-$, said anions acting as complexing agents for the uranium and impurities, said impurities being precipitated by means of an alkaline agent, said method comprising the following steps carried out for the purpose of selectively and quantitatively separating the impurities from the uranium:

(a) bringing said uraniferous solution to a temperature of at least 40° C.;

(b) adjusting the content of complexing agent to bring the molar ratio:

[complexing agent]/[soluble U+Zr and/or Hf]

to at least 3;

(c) introducing an alkaline agent to adjust the pH of said solution to between 2.2 and 4.3; and (d) separating the alkaline-treated solution into a solid phase and a liquid phase, said liquid phase comprising a purified uraniferous solution, and said solid phase comprising a zirconium and/or hafnium precipitate.

2. The method of claim 1, wherein said uraniferous solution is brought to a temperature between 80° C. and the boiling point of the solution.

3. The method of any of claims 1 or 2, wherein the content of complexing agent is adjusted to a molar ratio of at least 5.

4. The method of claim 3, wherein the alkaline agent is selected from the group comprising alkaline and ammonium hydroxides, carbonates and bicarbonates.

5. The method of claim 3, wherein the alkaline agent is introduced over a period of at least 10 minutes.

6. The method of claim 3, wherein the alkaline agent is introduced in the form of an aqueous solution with a molar concentration no greater than four.

7. The method of claim 3, wherein a fraction of the zirconium and/or hafnium precipitate obtained in step (d) is recycled to step (a).

* * * * *